US005883552A

United States Patent [19]

McKay

[11] Patent Number: 5,883,552

[45] Date of Patent: Mar. 16, 1999

[54] MICROWAVE POWER DIVIDER/COMBINER STRUCTURES

[75] Inventor: James P. McKay, Manhattan Beach, Calif.

[73] Assignee: Hughes Electronics Corporation, El Segundo, Calif.

[21] Appl. No.: 963,884

[22] Filed: Nov. 4, 1997

[51] Int. Cl.[6] ..... H01P 5/12

[52] U.S. Cl. ..... 333/125; 333/127; 333/128

[58] Field of Search ..... 333/117, 123, 333/125, 127, 128, 136, 137

[56] References Cited

U.S. PATENT DOCUMENTS

| | | | |
|---|---|---|---|
| 2,801,391 | 7/1957 | Whitehead | 333/125 X |
| 3,678,415 | 7/1972 | Kurada | 333/117 |
| 5,237,294 | 8/1993 | Roederer et al. | 333/117 |
| 5,283,540 | 2/1994 | Myer | 333/127 |

FOREIGN PATENT DOCUMENTS

| | | | |
|---|---|---|---|
| 1094093 | 5/1984 | Somalia | 333/127 |

OTHER PUBLICATIONS

Kawaii, Tadashi, et al., "A Branch–Line–Type Eight –Port Comparator Circuit", *1991 IEEE MTT–S Digest, pp. 869–872.*

Ohta, Isao, et al., "A Transmission–Line–Type Eight–Port Hybrid", *1992 IEEE MTT–S Digest*, pp. 119–122.

*Primary Examiner*—Paul Gensier

*Attorney, Agent, or Firm*—Georgann S. Grunebach; M. W. Sales

[57] ABSTRACT

Microwave power divider/combiners are provided which divide received powers at each of $2^n$ input ports transmit the divided powers to each of $2^n$ output ports and combine the transmitted powers at each of the output ports. They have through transmission lines which each couple respective pairs of the input and output ports. In addition, they include shunt transmission lines, an input network of transmission lines which couples the input ports to first ends of the shunt transmission lines and an output network of transmission lines which couples second ends of the shunt transmission lines to the output ports to thereby provide transmission paths from each of the input ports to each of the output ports. The input and output transmission-line networks are configured to be identical and to cause the power divider/combiner to have interport symmetry between the input and output ports and intraport symmetry between any equal sets of input and output ports.

37 Claims, 9 Drawing Sheets

MICROWAVE POWER DIVIDER/COMBINER STRUCTURES

BACKGROUND OF THE INVENTION

1. Field of the Invention

The present invention relates generally to passive microwave devices and more particularly to microwave power divider/combiners.

2. Description of the Related Art

Microwave devices are generally divided into the broad categories of passive and active devices. Included under the heading of passive microwave devices are microwave hybrids and microwave couplers which are multiport networks that are specifically configured for signal routing between the network ports. A device port into which power is normally fed is typically referred to as an incident port or an input port. A port from which power is extracted is called a coupled port or an output port and other ports (from which power is not extracted) are called isolated ports.

The term coupler usually refers to signal routing devices in which the power at one output port is different from that at another output port. In an exemplary four-port directional coupler, most of the power incident upon port 1 is directed to port 2 with a smaller portion (e.g., −20 dB) directed to port 3 and only a leakage portion reaching port 4. In terms of power ratios $P_n/P_m$, this coupler is said to have a coupling factor=$P_1/P_3$, a directivity=$P_3/P_4$ and an isolation=$P_1/P_4$. The low-level signal at port 3 is especially useful for monitoring a characteristic of the port 2 signal (e.g., its power level) or for serving as a sample of the port 2 signal in a control process (e.g., as in a feedback control loop).

In contrast to microwave couplers, microwave hybrids generally divide the power at each of a plurality of input ports into equal portions, transmit each of the divided portions to a respective one of a plurality of output ports and combine the transmitted powers at each output port. Accordingly, microwave hybrids are often called power divider/combiners.

An exemplary four-port (2×2) power divider/combiner has two input ports and two output ports. In a perfect divider/combiner, the incident power at each input port would be divided into two equal portions which are each transmitted to a respective one of the output ports (i.e., the power division is perfect). None of the incident power would be reflected from the input ports and none of the power at any one of the input ports would be transmitted to the other input ports (i.e., the input ports are perfectly matched to their power sources and the isolation between input ports is perfect).

FIG. 1A illustrates a conventional 2×2 divider/combiner 20 which has two input ports 22 (labeled as ports 1 and 2) and two output ports 24 (labeled as ports 3 and 4) that are formed with short transmission-line members 25 having a characteristic impedance $Z_c$ (e.g., 50 ohms). The input ports are coupled with branch transmission members 26 which have a length of $\lambda_g/4$ (where $\lambda_g$ is the guide (i.e., transmission-line) wavelength of signals at the design center of the divider/combiner). Each input port is coupled to a respective output port with through transmission members 28 which also have a length of $\lambda_g/4$.

Typically, the branch transmission lines have an impedance $Z_c$ and the through transmission lines have an impedance $Z_c/(2)^{1/2}$. In FIG. 1A, the divider/combiner 20 is shown as it would appear if its transmission-line members were realized with-planar transmission lines (e.g., microstrip).

Because the impedance of planar transmission lines is inversely related to their width, the through transmission lines 28 are wider than the branch transmission lines 26.

FIG. 1B illustrates another 2×2 divider/combiner 30 which is similar to the divider/combiner 20 of FIG. 1A with like elements represented by like reference numbers. However the divider/combiner 30 is realized with circular transmission-line members and is typically called a hybrid ring.

The 2×2 divider/combiner 20 of FIG. 1 can be used as a building block to construct larger divider/combiners such as the 4×4 divider/combiner 40 of FIG. 2 which has been described in various references (e.g., see Kawai, Tadashi, et al., "A Branch-Line-Type Eight-Port Comparator Circuit", 1991 *IEEE MTT-S Digest*, pp. 869–872). Essentially, the divider/combiner 40 is formed from four 2×2 divider/combiners 42, 44, 46 and 48 and has input ports 52 (labeled as ports 1, 2, 3 and 4) and output ports 54 (labeled as ports 5, 6, 7 and 8). The 2×2 divider/combiners are arranged so that output signals of some divider/combiners become input signals of other divider/combiners. For example, the divider/combiner 42 (the structure within the curved line 42) has its output ports (ports 3 and 4 in FIG. 1A) coupled respectively to be an input port (port 1 in FIG. 1A) for the divider/combiner 44 (the structure within the curved line 44) and an input port (port 2 in FIG. 1A) for the divider/combiner 46 (the structure within the curved line 46).

Although FIG. 2 shows the 4×4 divider/combiner arranged in a planar configuration, many other spatial configurations can be devised. For example, the 4×4 divider/combiner 60 of FIG. 3 is formed by folding the divider/combiners 42 and 48 of FIG. 2 in one direction and folding the divider/combiners 44 and 46 of FIG. 2 in an opposite direction. Thus the input ports 52 are positioned in one plane and the output ports 54 are positioned in another parallel plane. In FIG. 3, transmission members are indicated by lines and those having an impedance of $Z_c,(2)^{1/2}$ are indicated with a heavier line than those having an impedance of $Z_c$.

Another 4×4 divider/combiner 70 is shown in FIG. 4 to have input ports 72 (ports given the odd numbers of 1, 3, 5 and 7) and output ports 74 (ports given the even numbers of 2, 4, 6 and 8) which carry the same port labels as the divider/combiner 60 of FIG. 3. As typically described (e.g., see Ohta, Isao, et al., "A Transmission-Line-Type Eight-Port Hybrid",1992 *IEEE MTT-S Digest,* pp. 119–122), it has a ring 76 of transmission lines which each have a length of $\lambda_g/4$ and two cross transmission lines 78 which have a length of $\lambda_g/2$.

Although most conventional power divider/combiners successfully divide powers received at input ports and combine these divided powers at output ports, they typically include an excessive number of transmission-line members. Their use in microwave circuits, therefore, has a negative effect upon the size and weight of these circuits. This effect is emphasized when the hybrid's transmission-line members are realized in waveguide or coaxial form and the effect is especially costly when such realizations are intended for weight-sensitive applications such as spacecraft.

An exemplary spacecraft antenna array has a beam forming network which includes twenty two coaxial 8×8 hybrids (each hybrid is formed with twelve 2×2 hybrids that are similar to the hybrid 20 of FIG. 1A). The twenty two hybrids weigh approximately 21 kilograms. Because spacecraft launch costs are currently in the region of $88,000 per kilogram, the twenty two hybrids represent $1,848,000 in launch costs. Power divider/combiners that can be realized with less transmission-line members would obviously provide significant cost savings.

SUMMARY OF THE INVENTION

The present invention is directed to microwave power divider/combiners which have $2^n$ input ports and $2^n$ output ports (wherein n is an integer>1) and which require fewer transmission-line members than conventional power divider/combiners. Accordingly, the volume and weight of these power divider/combiners is reduced from that of conventional devices. These volume and weight reductions can yield significant cost savings in weight-sensitive applications such as spacecraft.

These goals are achieved with power divider/combiners that have $2^n$ through transmission lines which each couple a respective one of the input ports to a respective one of the output ports. In addition, they include shunt transmission lines, an input network of transmission lines which couples first ends of the shunt transmission lines to the input ports and an output network of transmission lines which couples second ends of the shunt transmission lines to the output ports. The input and output networks are identical so that the power divider/combiner has interport symmetry between the input and output ports and intraport symmetry between equal sets of input ports and equal sets of output ports.

In particular, the input network includes at least $2^n$ input branch transmission lines which each couple a respective one of the input ports to a respective one of the first ends of the shunt transmission lines. Similarly, the output network includes at least $2^n$ output branch transmission lines which each couple a respective one of the second ends of the shunt transmission lines to a respective one of the output ports.

The input network is arranged so that a plurality of input branch transmission lines couple each first end of the shunt transmission lines to an even-numbered set of the input ports. Likewise, the output network is arranged so that a plurality of output branch transmission lines couple each second end of the shunt transmission lines to an even-numbered set of the output ports.

The shunt transmission lines and the input and output networks establish transmission paths which supplement the through transmission lines so as to achieve perfect power division while not degrading the perfect return loss and isolation of the through transmission lines.

Power divider/combiner embodiments of the invention can be realized with various types of microwave transmission lines (e.g., waveguides, coaxial lines and planar transmission lines). Specific 4×4, 8×8 and 16×16 power divider/combiner embodiments are shown and described below. These embodiments have fewer transmission lines than corresponding conventional power divider/combiners. In addition, analyses of these embodiments have found that they generally have superior return loss, isolation and power division bandwidths and less insertion loss.

Specific applications of the invention include multiple beam antenna systems, antenna array feed networks and other microwave power distribution networks.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 1A:
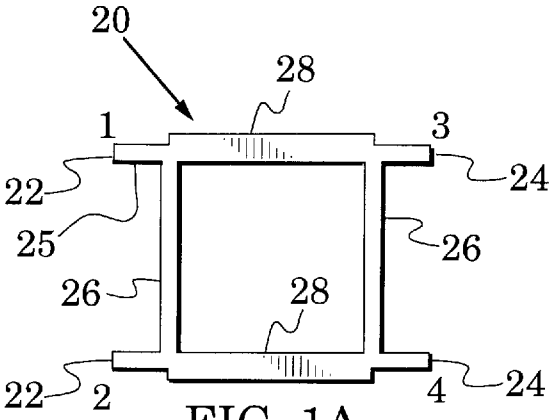
FIG. 1A (PRIOR ART)
FIG. 1A is a plan view of a conventional 2×2 power divider/combiner.

The teachings of the present invention are generally directed to $2^n \times 2^n$ power divider/combiners wherein n is an integer>1. However, these teachings can be best understood if they are initially described with reference to specific power divider/combiner embodiments. Accordingly, attention is first directed to the 4×4 power divider/combiner 80 of FIG. 5. This passive microwave device is illustrated as it would appear with its transmission lines realized in transmission members that support transverse electromagnetic (TEM) modes of propagation. In particular, the transmission lines are shown as square coaxial members.

The power divider/combiner 80 is particularly suited for dividing received powers at each of four input ports 82, 83, 84 and 85 (indicated in broken lines), transmitting the divided powers of each input port to four output ports 86, 87, 88 and 89 and combining the transmitted powers at each of the output ports.

It includes four through transmission lines 90 which each couple a respective one of the input ports to a respective one of the output ports. The power divider/combiner also has a shunt transmission line 92. Finally, it has four input branch transmission lines 94 which each couple a respective one of the input ports and a first end 95 of the shunt transmission line 92 and four output branch transmission lines 96 which each couple a respective one of the output ports and a second end 97 of the shunt transmission line 92.

To facilitate coupling of signals to the input and output ports, the through transmission lines 90 can each include extensions 99 which extend away from the input and output ports. The length of these extensions is not important as only the length of the transmission lines between the input ports and the output ports determines the device's operation.

Figures 5, 6:
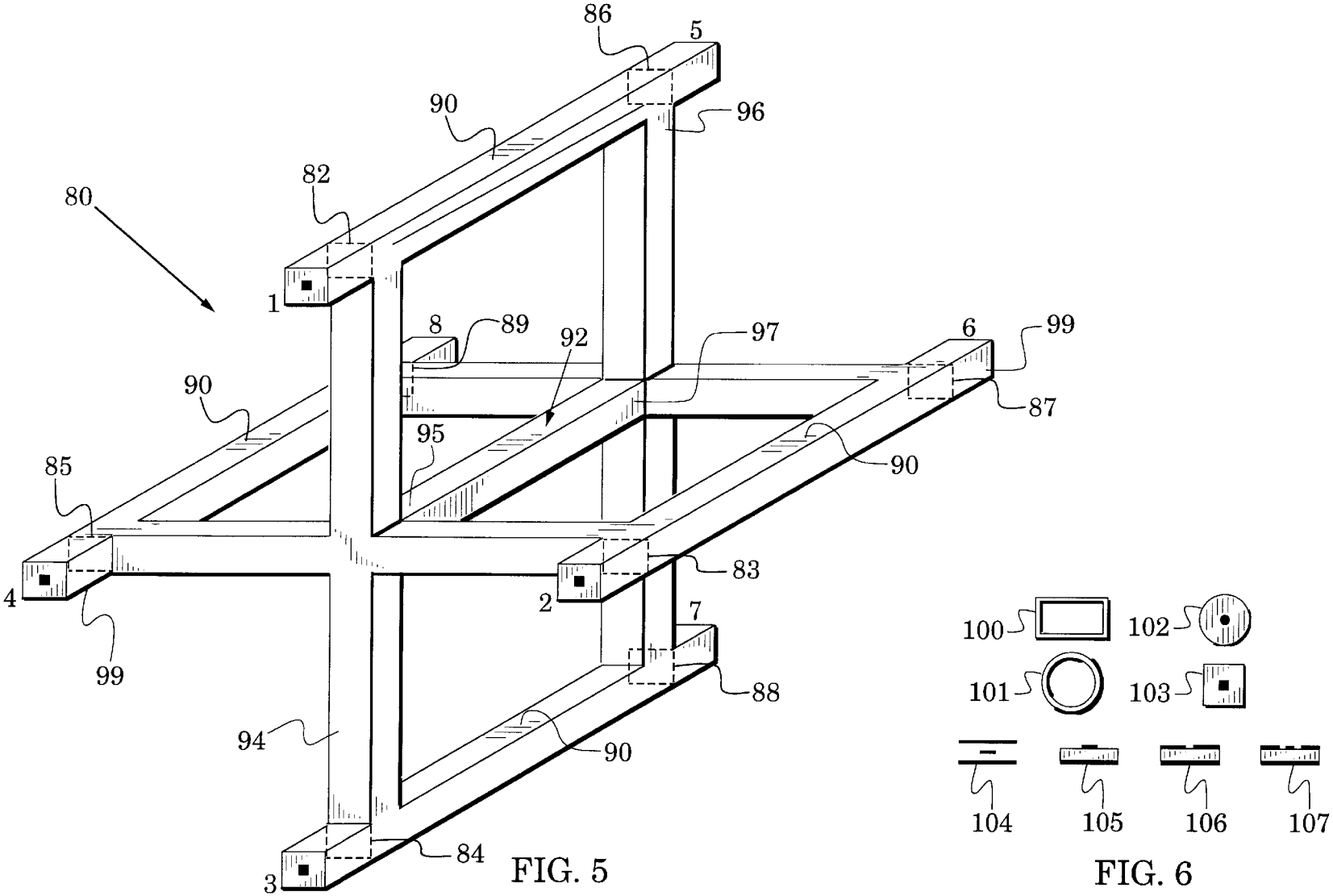
FIG. 5 is a perspective view of a 4×4 power divider/combiner of the present invention.
FIG. 6 includes cross-sectional views of exemplary transmission lines for forming embodiments of the power divider/combiner of FIG. 5.

Although the power divider/combiner 80 of FIG. 5 is illustrated as it would appear in a coaxial transmission-line embodiment, divider/combiner embodiments of the invention can be realized with any transmission-line members. Accordingly, exemplary transmission lines are illustrated in FIG. 6. They include waveguides (e.g., rectangular waveguide 100 and circular waveguide 101), coaxial lines (e.g., circular coax 102 and square coax 103) and planar transmission lines (e.g., stripline 104, microstrip 105, slot line 106 and coplanar 107).

Power divider/combiners of the invention can be structurally varied to enhance their performance in specific applications. In a first variation of the power divider/combiner 80, its transmission lines have equal electrical lengths which are preferably $\lambda_g/4$ in which $\lambda_g$ is the guide wavelength of signals at the center design frequency of the divider/combiner.

Typically, the 4×4 power/combiner 80 would be coupled into a transmission-line system that is configured with a characteristic impedance $Z_c$ (e.g., 50 ohms) and, in this case, the transmission-line extensions 99 would also preferably have an impedance $Z_c$. To enhance the performance of the first variation, the through transmission lines 90, the input branch transmission lines 94 and the output branch transmission lines 96 would each have an impedance $Z_c$ and the shunt transmission line 92 would have an impedance $Z_c/2$. If $Z_c$ is 50 ohms, for example, then the power divider/combiner 80 has twelve transmission lines of 50 ohms impedance and one transmission line of 25 ohms impedance.

A description of second and third variations of the power divider/combiner 80 are preceded by the following operational description of the first variation. At the center design frequency of the first variation, a signal incident upon any of the input ports (82, 83, 84 and 85) is coupled equally to each of the output ports (86, 87, 88 and 89). Therefore, the power at each output port is ~6.02 dB below the incident power (i.e., the device's power division is perfect). If only one input port is driven (e.g., port 82), the signal phase at the nearest output port (e.g., port 86) is +180° relative to the signal phase at the other output ports. The reflected signal from the input port is zero and the signal coupled to the other input ports is also zero (i.e., the device's isolation is perfect). This signal operation is summarized in the device's midband scattering matrix of $$[S] = \left(\frac{1}{2}j\right)\begin{bmatrix} 0 & 0 & 0 & 0 & -1 & 1 & 1 & 1 \\ 0 & 0 & 0 & 0 & 1 & -1 & 1 & 1 \\ 0 & 0 & 0 & 0 & 1 & 1 & -1 & 1 \\ 0 & 0 & 0 & 0 & 1 & 1 & 1 & -1 \\ -1 & 1 & 1 & 1 & 0 & 0 & 0 & 0 \\ 1 & -1 & 1 & 1 & 0 & 0 & 0 & 0 \\ 1 & 1 & -1 & 1 & 0 & 0 & 0 & 0 \\ 1 & 1 & 1 & -1 & 0 & 0 & 0 & 0 \end{bmatrix}.$$

The information communicated by the device scattering matrix can be understood by remembering that power is indicated by the square of each scattering matrix element and by examining a few exemplary elements. The first column of the scattering matrix begins with $S_{11}=0$ which indicates that no power is reflected from input port 82. The next three elements are $S_{21}=0$, $S_{31}=0$ and $S_{41}=0$ which indicates that no power is transmitted from the input port 82 to the input ports 83, 84 and 85.

The first column ends with $S_{51}=j½$, $S_{61}=j½$, $S_{71}=j½$ and $S_{81}=j½$. The squares of these matrix elements are −¼, −¼, −¼ and −¼ which indicates that the power at the input port 82 is equally divided among the output ports 86, 87, 88 and 89 and the signal phase at the output port 86 is 180° out of phase compared to the signal phase at the other output ports. Finally, the scattering matrix is symmetric about a diagonal which indicates that the operation of the power divider/combiner 80 is not altered if the input and output ports are interchanged.

Figure 2:
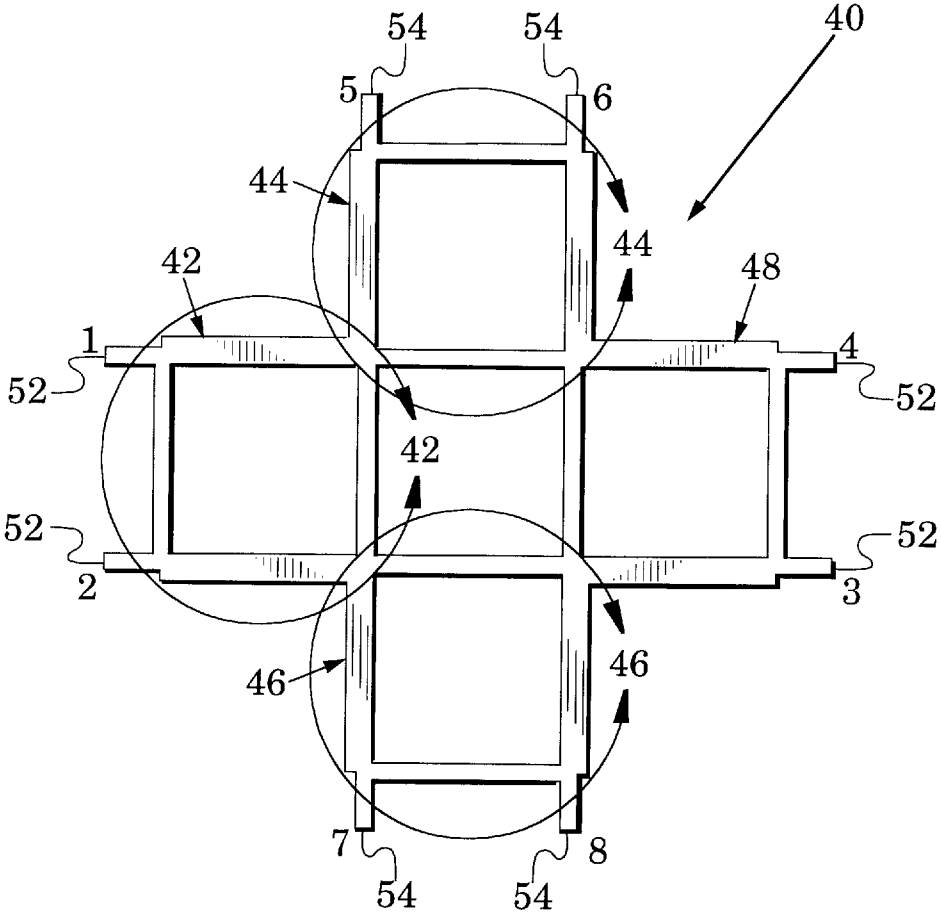
FIG. 2 (PRIOR ART)
FIG. 2 is a plan view of a conventional 4×4 power divider/combiner which is formed from the power divider/combiner of FIG. 1A.
Figure 4:
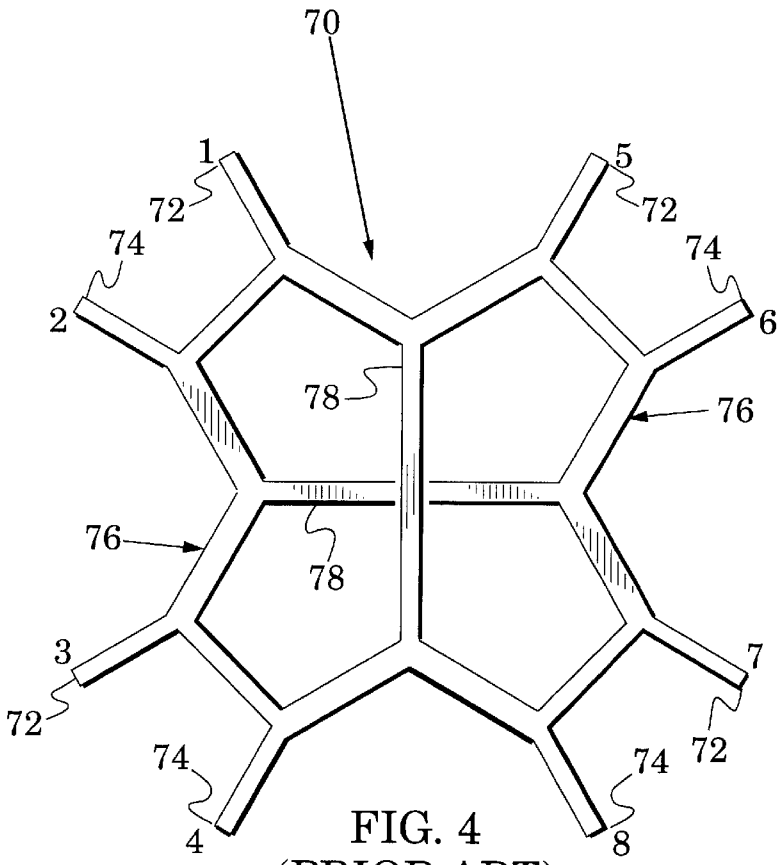
FIG. 4 (PRIOR ART)
FIG. 4 is a plan view of another 4×4 power divider/combiner of the prior art.
Figure 3:
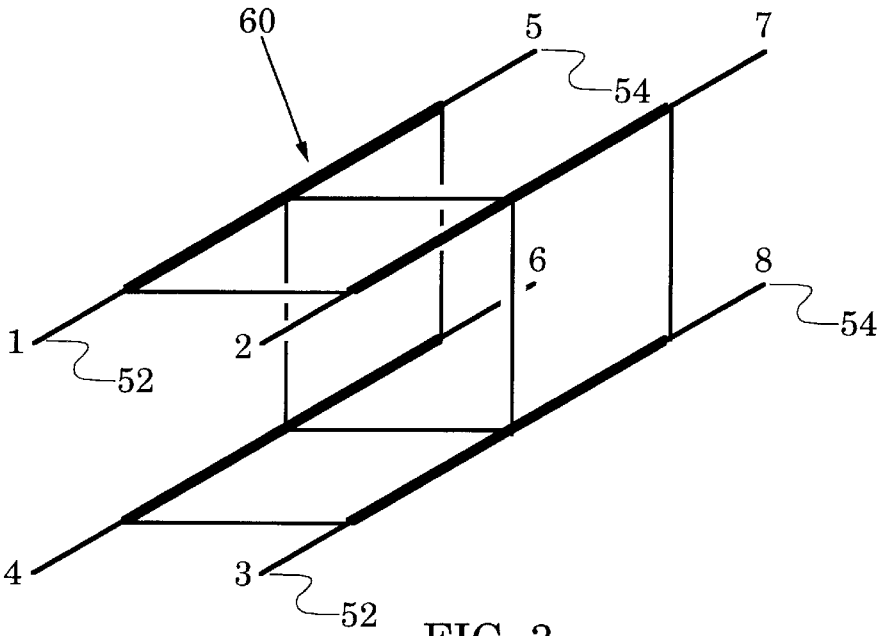
FIG. 3 (PRIOR ART)
FIG. 3 is a schematized perspective view of the power divider/combiner of FIG. 2 with its input and output ports rotated in opposite directions.

The power divider/combiner 40 of FIG. 2 has sixteen transmission lines which are each $\lambda_g/4$ in length. The prior art power divider/combiner 70 of FIG. 4 has twelve transmission lines which are each $\lambda_g/4$ in length and two transmission lines which are each $\lambda_g/2$ in length (therefore its weight is equivalent to sixteen transmission lines of length $\lambda_g/4$).

In contrast, the first variation of the power divider/combiner 80 of FIG. 5 offers significant weight and volume savings as it only has thirteen transmission lines which are each preferably $\lambda_g/4$ in length. Because the impedance of coaxial transmission lines is inversely related to their center conductor's cross section, high impedance coaxial lines are lighter than low impedance lines. Thus, when realized with coaxial transmission lines, the power divider/combiner 80 provides additional weight savings as it only has one low impedance transmission line. A similar (but perhaps less pronounced) additional weight savings is obtained with waveguide versions of the power divider/combiner 80.

Because of the reduction of transmission-line members, it has been calculated that the weight of an exemplary large antenna beam-forming network can be reduced ~2.6 kilograms by replacing conventional power divider/combiners with the structure of FIG. 5. At current spacecraft launch costs of $88,000 per kilogram, this represents a significant savings of ~$232,000.

The performance of the power divider/combiner 80 of FIG. 5 has been investigated with an even/odd mode analysis that involves excitation of input and output ports with in-phase and opposite-phase signals. The power divider/combiner has also been modeled on a network simulator in which the finite conductivity of real transmission lines was taken into account. Finally, the power divider/combiner has been modeled on an electromagnetic structure simulator which includes transmission line junction effects in its simulation. The results of the network simulator and the electromagnetic structure simulator substantially confirm the findings of the even/odd mode analysis which is summarized in FIGS. 7A–7C.

Figure 7B:
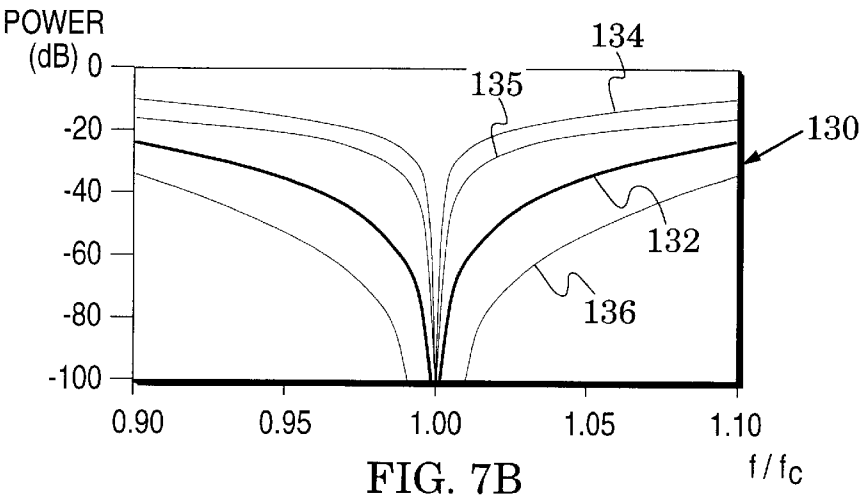
FIGS. 7A–7C are graphs which respectively show calculated return loss, isolation and output power division in the power divider/combiner of FIG. 5.
Figure 7A:
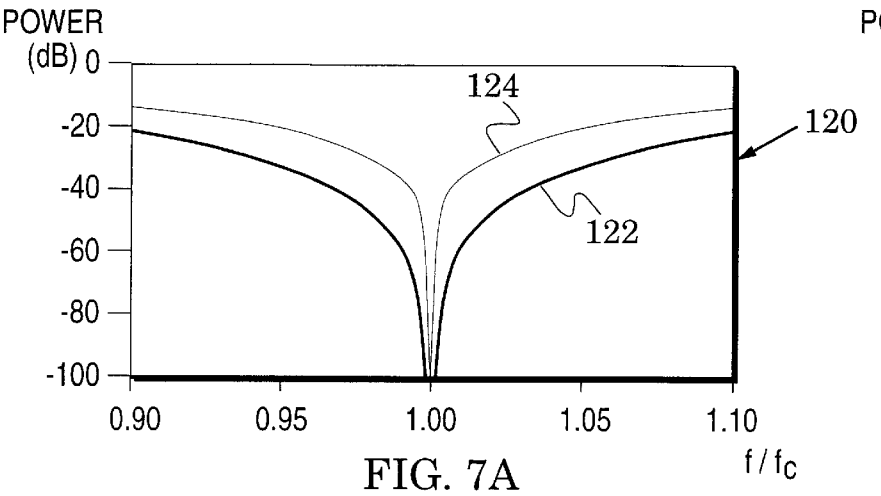

The graph 120 of FIG. 7A shows a plot 122 of return loss for an input port in the first power divider/combiner variation described above (return loss is a ratio of power reflected from a port to power incident upon that port). In contrast, plot 124 shows return loss for the power divider/combiner 40 of FIG. 2. For any selected return loss, the power divider/combiner 80 is seen to have a wider bandwidth.

The graph 130 of FIG. 7B includes a plot 132 of isolation between a driven input port and other input ports in the first power divider/combiner variation. Only one plot is required because the isolation is the same for all other input ports. In contrast, plots 134, 135 and 136 respectively show isolation between a driven input port 1 and input ports 2, 3 and 4 in the power divider/combiner 40 of FIG. 2. For any selected isolation at all ports, the graph 130 illustrates that the power divider/combiner 80 has a wider bandwidth.

Figure 7C:
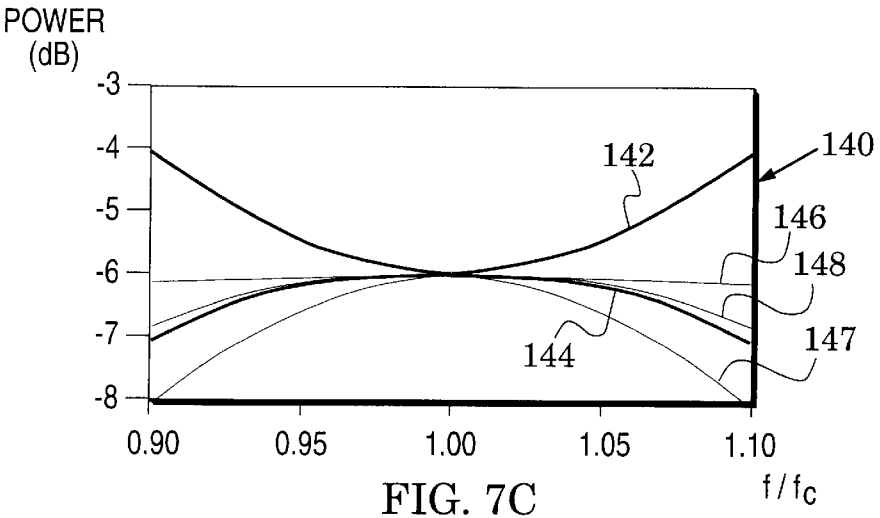

For the first power divider/combiner variation, graph 140 of FIG. 7C has a plot 142 of output power at output port 5 and a plot 144 of output power at output ports 6, 7 and 8 when port 1 is a driven input port. For comparison, plots 146 and 147 show output power respectively at output ports 8 and 5 of the power divider/combiner 40 of FIG. 2 when port 1 is a driven input port. Plot 148 shows output power at output ports 6 and 7. For bandwidths less than 10%, the power division of the power divider/combiner 80 and the power divider/combiner 40 are substantially equal. For greater bandwidths, the power division of the power divider/combiner 40 is superior. Although not shown in any of the graphs 120, 130 and 140, the power divider/combiner 80 also offers less insertion loss than conventional devices because of its reduced number of transmission lines.

In a second variation of the power divider/combiner 80, the first variation described above is modified by causing the impedance $Z_b$ of the input and output branch lines 94 and 96 and the impedance $Z_s$ of the shunt line 92 to be related by the equation $Z_b^2/Z_s=2Z_c$. The impedance of the through transmission lines remains $Z_c$. An even/odd mode analysis of this variation has shown that an increase in $Z_s$ (and, hence, in $Z_b$) improves the return loss plot 122 in FIG. 7A and degrades the output power division plots 142 and 144 of FIG. 7C. Alternatively, a decrease in $Z_s$ (and, hence, in $Z_b$) degrades the return loss plot 122 and improves the output power division plots 142 and 144. Isolation is substantially unaffected.

In a third variation of the power divider/combiner 80, the first variation above is modified by selecting the electrical length of the through transmission lines 90 to be θ and by relating the impedance $Z_b$ of the input and output branch lines 94 and 96 to the impedance $Z_s$ of the shunt line 92 by the equation $Z_b^2/Z_s=2Z_c\sin\theta$. The impedance of the through transmission lines remains $Z_c$. An even/odd mode analysis of this variation has shown that the electrical length of the through transmission lines (90 in FIG. 5) can be reduced with a consequent bandwidth reduction for any selected specification of return loss, isolation or power division. This feature of the invention permits a further reduction in volume and weight in applications in which less bandwidth of these parameters is acceptable.

Figure 8:
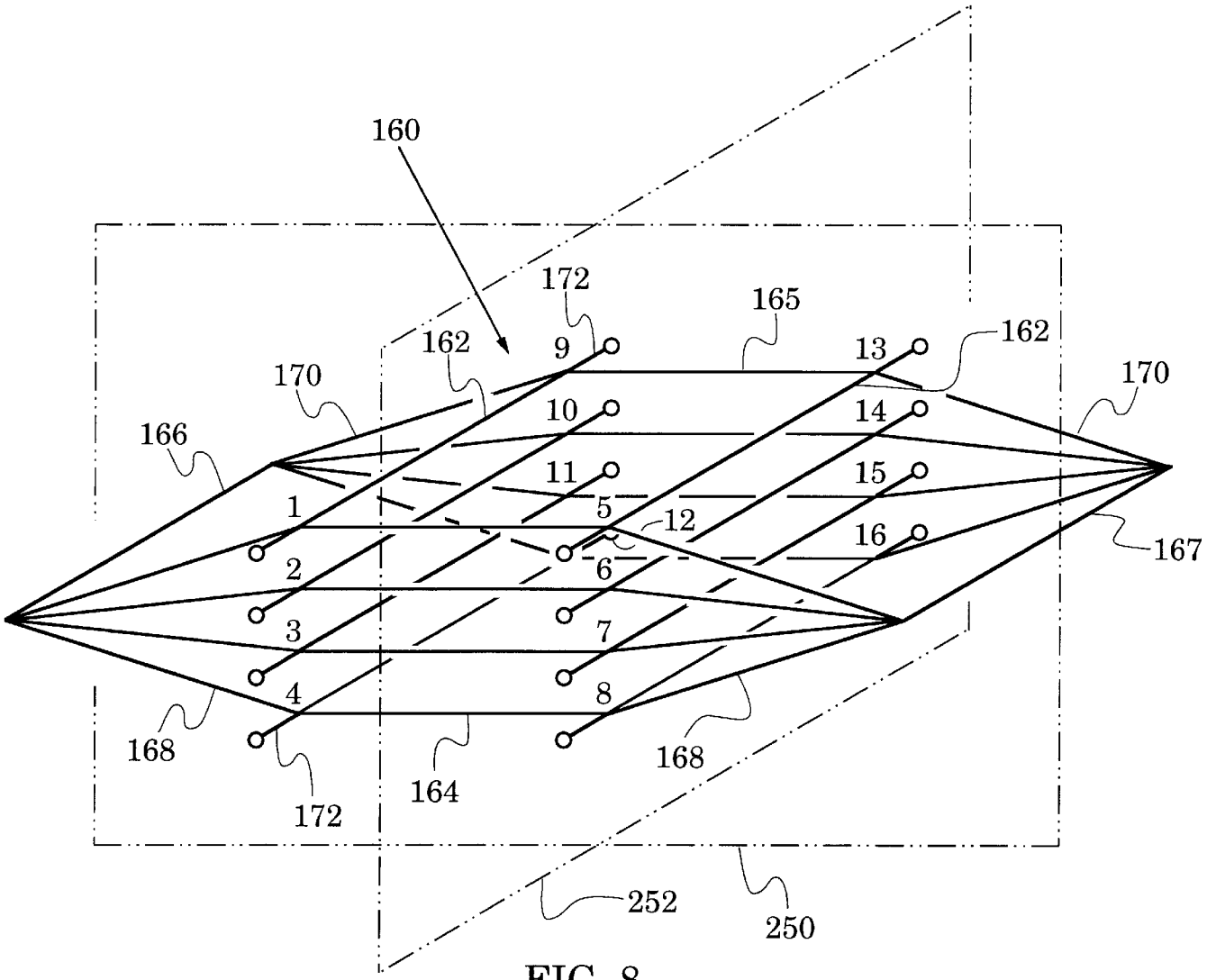
FIG. 8 is a schematized perspective view of an 8×8 power divider/combiner of the present invention.

Attention is now directed to the 8×8 power divider/combiner 160 of FIG. 8. The power divider/combiner 160 is particularly suited for dividing received powers at each of eight input ports which are labeled with port numbers 1–8, transmitting the divided powers of each input port to eight output ports which are labeled with port numbers 9–16 (output port 12 is hidden behind input port 5) and combining the transmitted powers at each of the output ports.

The power divider/combiner 160 includes eight through transmission lines 162, four input transverse transmission lines 164, four output transverse transmission lines 165, first and second shunt transmission lines 166 and 167, eight input branch transmission lines 168 and eight output branch transmission lines 170. To facilitate coupling of signals to the input and output ports, the through transmission lines 162 can each include extensions 172 which extend away from the input and output ports. As stated previously, the length of these extensions is not important as only the length and characteristic impedance of the transmission lines between the input ports and the output ports determines the device's operation.

As shown in FIG. 8, four of the through transmission lines 162 each couple a respective input port of a first set of the input ports to a respective output port of a first set of the output ports wherein the first input-port set includes the input ports 1–4 and the first output-port set includes the output ports 9–12. Another four of the through transmission lines 162 each couple a respective input port of a second set of the input ports to a respective output port of a second set of the output ports wherein the second input-port set includes the input ports 5–8 and the second output-port set includes the output ports 13–16.

The four input transverse transmission lines 164 each couple a respective input port of the first input-port set and a respective input port of the second input-port set. Similarly, the four output transverse transmission lines 165 each couple a respective output port of the first output-port set and a respective output port of the second output-port set.

Four of the input branch transmission lines 168 each couple a first end of the first shunt transmission line 166 to a respective input port of the first input-port set and another four of the input branch transmission lines 168 each couple a first end of the second shunt transmission line 167 to a respective input port of the second input-port set.

Finally, four of the output branch transmission lines 170 each couple a first end of the first shunt transmission line 166 to a respective output port of the first output-port set and another four of the output branch transmission lines 170 each couple a first end of the second shunt transmission line 167 to a respective output port of the second output-port set. To enhance its operation, the transmission lines have the same electrical length which is preferably $\lambda_g/4$ when the power divider/combiner is configured for operation with signals having a guide wavelength $\lambda_g$. Although its transmission line impedances may be different, each side of the power divider/combiner 160 (e.g., the side which consists of the through transmission lines 162, the branch transmission lines 168 and'170 and the shunt transmission line 166) is essentially the power divider/combiner 80 of FIG. 5 with the elements rotated to bring the through lines closer together.

Typically, the 8×8 power divider/combiner 160 would be coupled into a transmission-line system that is configured with a characteristic impedance $Z_c$ (e.g., 50 ohms). In this case, the transmission-line extensions 172 would also preferably have an impedance $Z_c$. To enhance the performance of the 8×8 power divider/combiner in this system, the input and output transverse transmission lines 164 and 165 have a characteristic impedance $Z_c$ and the through transmission lines 162 have an impedance $Z_t=Z_c/(2)^{1/2}$. In addition, the input and output branch transmission lines 168 and 170 have an impedance $Z_b$ and the shunt transmission lines 166 and 167 have an impedance $Z_s$ wherein $Z_b^2/Z_s=Z_c(2)^{1/2}$.

Figure 1B:
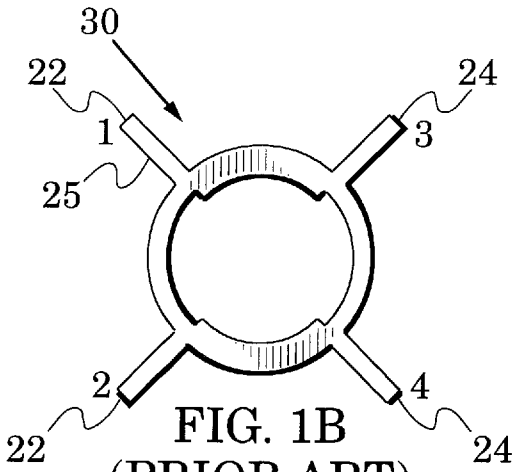
FIG. 1B (PRIOR ART)
FIG. 1B is a plan view of a circular form of the power divider/combiner of FIG. 1A.

The 8×8 power divider/combiner 160 of FIG. 8 has 34 transmission lines. When compared to a conventional 8×8 power divider/combiner that is realized with a combination of 2×2 power dividers (e.g., the power divider/combiner 20 of FIG. 1), the 8×8 power divider/combiner 160 achieves a reduction of 14 transmission lines and a reduction of ~30% in weight. In addition, the 8×8 power divider/combiner of the invention can reduce insertion loss by ~25%. Although an even/odd mode analysis of the 8×8 power divider/combiner 160 has shown its return loss and output power division to be somewhat inferior to that of conventional 8×8 power divider/combiners, its isolation is substantially the same.

Figure 9:
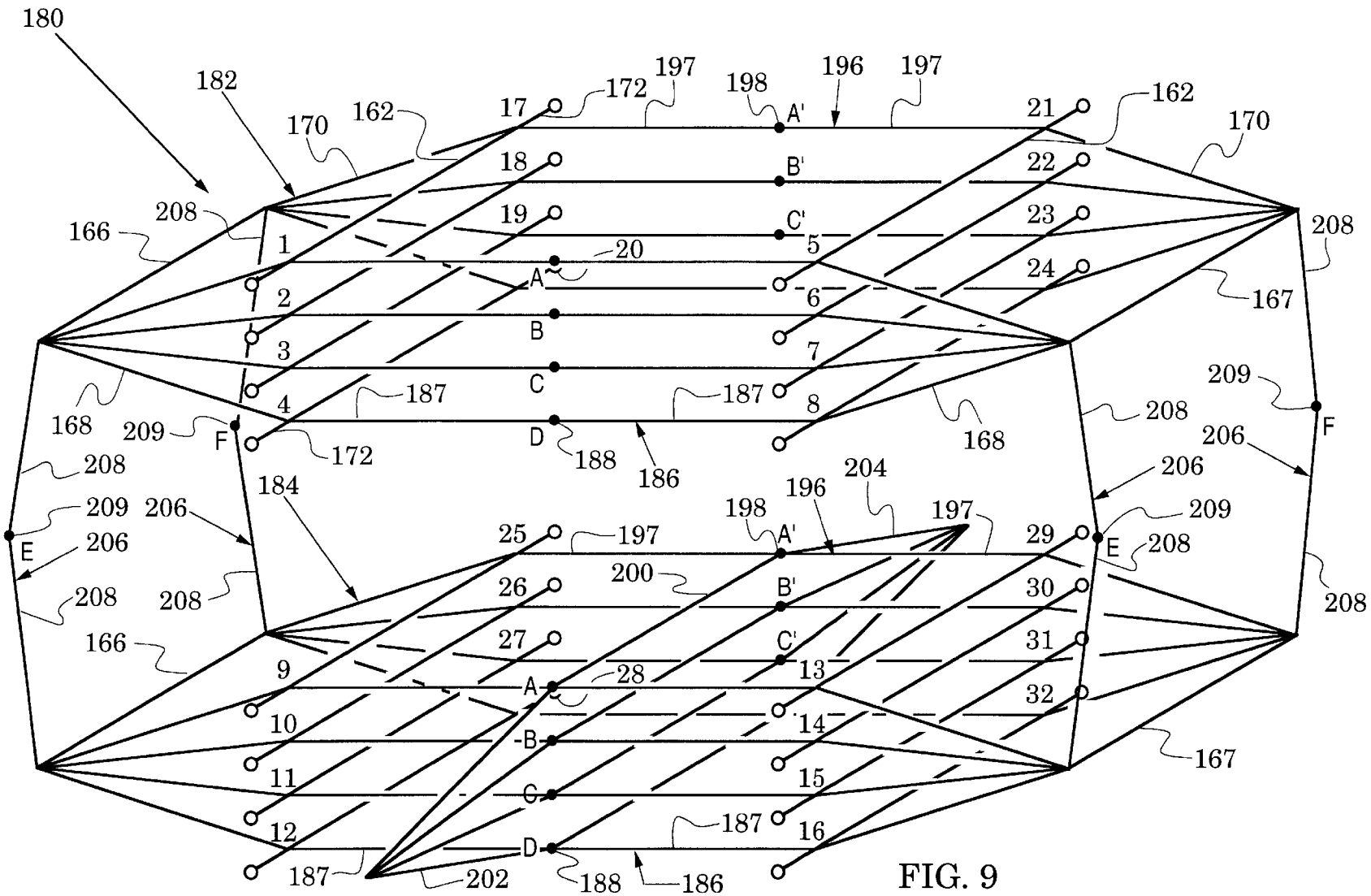
FIG. 9 is a schematized perspective view of a 16×16 power divider/combiner of the present invention.

Attention is now directed to the 16×16 power divider/combiner 180 of FIG. 9. The power divider/combiner 180 is particularly suited for dividing received powers at each of sixteen input ports which are labeled with port numbers 1–16, transmitting the divided powers of each input port to sixteen output ports which are labeled with port numbers 17–32 (output ports 20 and 28 are partially hidden) and combining the transmitted powers at each of the output ports.

The power divider/combiner 180 includes a first network of transmission lines 182 and a second network of transmission lines 184. The transmission-line networks are each similar to the power divider/combiner 160 of FIG. 8 with like elements indicated by like reference numbers (to avoid drawing confusion, the corresponding reference numbers are shown only for the first transmission-line network 182). The first transmission-line network 182 includes a first set of input ports 1–4, a second set of input ports 5–8, a first set of output ports 17–20 and a second set of output ports 21–24. The second transmission-line network 184 includes a third set of input ports 9–12, a fourth set of input ports 13–16, a third set of output ports 25–28 and a fourth set of output ports 29–32.

In each of the first and second transmission-line networks 182 and 184, however, the four input transverse transmission lines 164 of the power divider/combiner 160 are replaced by four input intrabranch transmission-line pairs 186 which each includes two input intrabranch transmission lines 187 that are serially joined at an input-pair node 188. Similarly, the four output transverse transmission lines 165 of the power divider/combiner 160 are replaced by four output intrabranch transmission-line pairs 196 that each includes two output intrabranch transmission lines 197 which are serially joined at an output-pair node 198.

Each of the input-pair nodes 188 of the first transmission-line network 182 is joined to a respective one of the input-pair nodes 188 of the second transmission-line network 184 so as to form a common node. For clarity of illustration, this is indicated in FIG. 9 by labeling the input-pair nodes 188 of the first and second transmission-line networks 182 and 184 as A, B, C and D. For example, the two input-pair nodes 188 that are labeled A are, in fact, one common node. Similarly, each of the output-pair nodes 198 of the first transmission-line network 182 is joined to a respective one of the output-pair nodes 198 of the second transmission-line network 184 so as to form a common node. This is indicated in FIG. 9 by labeling the output-pair nodes 198 of the first and second transmission-line networks 182 and 184 as A', B', C' and D'.

The 16×16 power divider/combiner 180 has four intrashunt transmission lines 200 which are each coupled between a respective one of the input-pair nodes 188 and a respective one of the output-pair nodes 198. In association with the intrashunt transmission lines 200, four input subbranch transmission lines 202 have first ends which are coupled together and second ends which are each coupled to a respective one of the input-pair nodes 188. In further association with the intrashunt transmission lines 200, four output subbranch transmission lines 204 have first ends which are coupled together and second ends which are each coupled to a respective one of the output-pair nodes 198.

Finally, the 16×16 power divider/combiner 180 includes four interbranch transmission-line pairs 206, each formed of two interbranch transmission lines 208 which are serially joined at a node 209. A first one of these interbranch transmission-line pairs 206 is coupled between the first ends of the first shunt transmission lines 166 of the first and second transmission-line networks 182 and 184. A second one is coupled between the first ends of the second shunt transmission lines 167 of the first and second transmission-line networks 182 and 184. A third one is coupled between the second ends of the first shunt transmission lines 166 of the first and second transmission-line networks 182 and 184. Lastly, a fourth one is coupled between the second ends of the second shunt transmission lines 167 of the first and second transmission-line networks 182 and 184.

The input nodes 209 which are labeled E in the first and second interbranch transmission-line pairs 206 are a common node, i.e., the ends of the associated interbranch transmission lines 208 couple together at the node E. Similarly, the input nodes 209 which are labeled F in the third and fourth interbranch transmission-line pairs 206 are a common node, i.e., the ends of the associated interbranch transmission lines 208 couple together at the node F.

It may be noted that the connection of ports 1, 5, 9 and 13 at node A is conceptually similar to the connection of nodes 1, 2, 3 and 4 to the first end of shunt transmission line 166 (i.e., shunt transmission line 200 is conceptually similar to shunt transmission line 166). Also, the input subbranch transmission lines 202, for example, are conceptually similar to the branch transmission lines 168 except that they connect junctions rather than ports.

The 16×16 power divider/combiner 180 has 104 transmission lines. In contrast, a 16×16 power divider/combiner realized with conventional 2×2 power dividers (e.g., the power divider/combiner 20 of FIG. 1) has 128 transmission lines. Thus, approximately 20% of the volume and weight of the conventional 16×16 power divider/combiner is eliminated.

For enhanced performance of the 16×16 power divider/combiner 180, its transmission lines should have the same electrical length which is preferably $\lambda_g/4$ wherein the power divider/combiner is configured for operation with signals having a guide wavelength $\lambda_g$. Typically, the power divider/combiner 180 would be coupled into a transmission-line system that is configured with a characteristic impedance $Z_c$ (e.g., 50 ohms). In this case, the transmission-line extensions 172 would also preferably have an impedance $Z_c$.

To further enhance the performance of an embodiment of the power divider/combiner 180, the through transmission lines 162 have a characteristic impedance $Z_c$. The input branch transmission lines 168, the output branch transmission lines 170, the input intrabranch transmission lines 187 and the output intrabranch transmission lines 197 have an impedance $Z_b$ and the shunt transmission lines 166 and 167 and the intrashunt transmission lines 200 have an impedance $Z_s$ wherein $Z_b^2/Z_s=2Z_c\sin\theta_t$ and $\theta_t$ is the electrical length of the through transmission lines. In this embodiment, the impedances of the intrabranch transmission lines 208 and the subbranch transmission lines 202 and 204 and the electrical length $\theta_t$ are selected in accordance with application needs (e.g., to enhance the bandwidth of the return loss, isolation or output power division parameters). Alternatively, the impedances can be increased to achieve additional weight savings with the lower weight of high-impedance lines.

Figure 10:
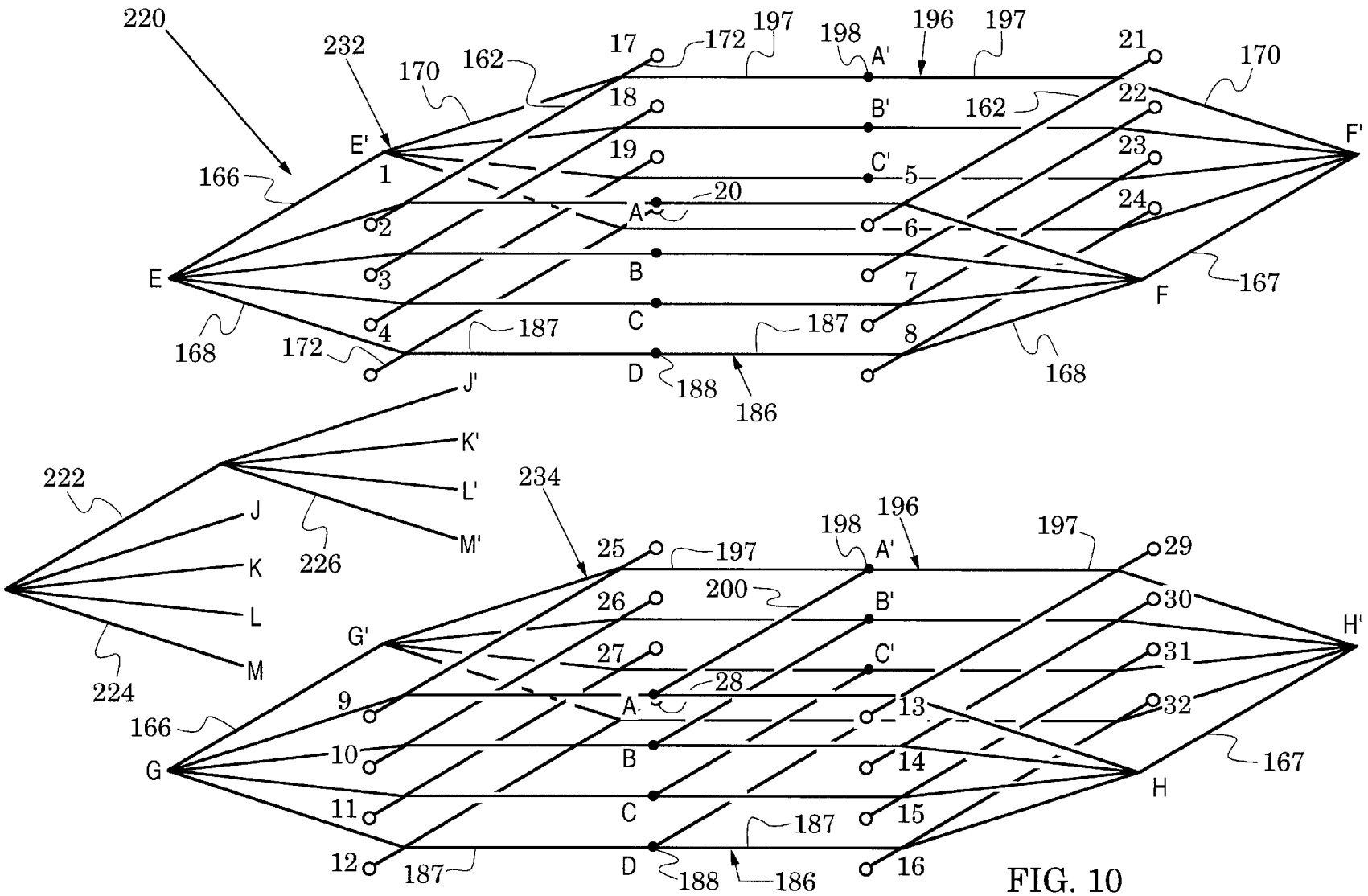
FIG. 10 is a schematized perspective view of another 16×16 power divider/combiner of the present invention.

Another 16×16 power divider/combiner 220 is shown in FIG. 10. The power divider/combiner 220 is similar to the power divider/combiner 180 of FIG. 9 with like elements indicated by like reference numbers. However, the input subbranch transmission lines 202, the output subbranch transmission lines 204 and the interbranch transmission-line pairs 206 are replaced by a secondary shunt transmission line 222, four input secondary branch transmission lines 224 connected to a first end of the secondary shunt and four output secondary branch transmission lines 226 connected to a second end of the secondary shunt.

Accordingly, the first network of transmission lines has been renumbered as 232 and the second network of transmission lines has been renumbered as 234. First and second ends of the shunt transmission line 166 of the first network 232 have been labeled E and E' and first and second ends of the shunt transmission line 167 have been labeled F and F'. First and second ends of the shunt transmission line 166 of the second network 234 have been labeled G and G' and first and second ends of the shunt transmission line 167 have been labeled H and H'. Unattached ends of the input secondary branch transmission lines 224 are labeled J, K, L and M and unattached ends of the output secondary branch transmission lines 226 are labeled J', K', L' and M'.

In a first embodiment of the power divider/combiner 220, line ends J, K, L and M couple respectively to A, B, C and D of the input-pair nodes 188 and line ends J', K', L' and M' couple respectively to A', B', C' and D' of the output-pair nodes 198 (D' is hidden behind output port 5). The secondary shunt transmission line 222, four input secondary branch transmission lines 224 and four output secondary branch transmission lines 226 are shown separately in FIG. 10 to avoid drawing confusion and also to illustrate a second embodiment of the power divider/combiner 220. In this second embodiment, the line ends J, K, L and M couple respectively to first ends E, F, G and H and line ends J', K', L' and M' couple respectively to second ends E', F', G' and H'.

The embodiments of the 16×16 power divider/combiner 220 have 97 transmission lines so that approximately 25% of the volume and weight of conventional 16×16 power divider/combiners is eliminated. For enhanced performance of the 16×16 power divider/combiner 220, its transmission lines should have the same electrical length which is preferably $\lambda_g/4$ wherein the power divider/combiner is configured for operation with signals having a guide wavelength $\lambda_g$. Typically, the power divider/combiner 220 would be coupled into a transmission-line system that is configured with a characteristic impedance $Z_c$ (e.g., 50 ohms). In this case, the transmission-line extensions 172 would also preferably have an impedance $Z_c$.

To enhance the performance of the power divider/combiner 220, the through transmission lines 162 have an impedance $Z_c$, the impedance $Z_b$ of the branch transmission lines 168 and 170, the impedance $Z_{ss}$ of the secondary shunt transmission line 222 and the impedance $Z_s$ of the shunt transmission lines 166 and 167 are related as $Z_b^2/Z_{ss}=2Z_s$. Also the impedance $Z_t$ of the transverse transmission lines 187 and 197 and the impedance $Z_s$ of the shunt transmission lines 166 and 167 are related as $Z_t^2/Z_s=2Z_c\sin\theta_t$ in which $\theta_t$ is the electrical length of the through transmission lines 162.

Preferably, the electrical length of the through transmission lines 162 is chosen to enhance a selected performance parameter (e.g., insertion loss) and the electrical length of the remaining lines is set to $\lambda_g/4$. An even/odd analysis has been made of the second power divider/combiner embodiment in which the electrical length of the through transmission lines 162 was set to $\lambda_g/4$, impedance $Z_t$ and impedance of lines 168, 170, 187 and 197 set were set to $Z_c$, impedance $Z_s$ and impedances of lines 224 and 226 were set to $Z_c/2$, and impedance $Z_{ss}$ was set to $Z_c/4$. The analysis showed that this second embodiment had a wider return loss bandwidth and a wider isolation bandwidth than conventional 16×16 power divider/combiners but a somewhat reduced power division bandwidth.

For simplicity of illustration, the transmission lines of the power divider/combiners 160 of FIG. 8, 180 of FIG. 9 and 220 of FIG. 10 have been indicated by solid lines but these lines can be realized with any conventional transmission line (e.g., the transmission lines shown in FIG. 6).

The power divider/combiner embodiments described above (i.e., power divider/combiners 80 of FIG. 5, 160 of FIG. 8, 180 of FIG. 9 and 220 of FIG. 10) are exemplary of the general teachings of the invention which are directed to power divider/combiners that have $2^n$ input ports and $2^n$ output ports wherein n>1. Specifically, n=2 in the power divider/combiner 80, n=3 in the power divider/combiner 160 and n=4 in the power divider/combiners 180 and 220.

Figure 11:
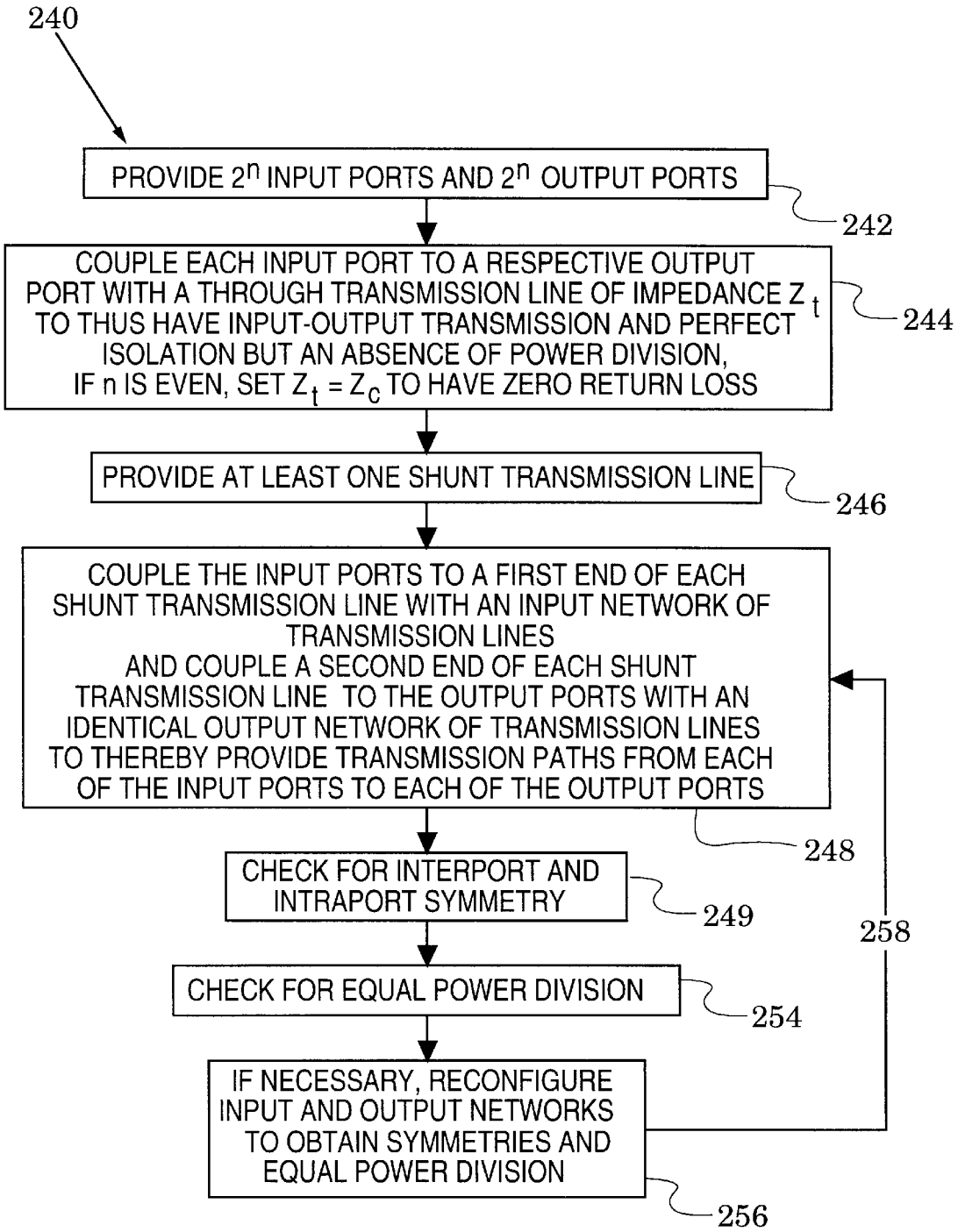
FIG. 11 is a flow diagram which illustrates design processes for $2^n \times 2^n$ power divider/combiners of the present invention.

These general teachings are further illustrated in the flow diagram 240 of FIG. 11 which illustrates design processes that realize a $\mathbf{2}_{n\times 2n}$ power divider/combiner. It is assumed that the power divider/combiner is designed for insertion into a network in which the transmission lines have a characteristic impedance $Z_c$ (e.g., 50 ohms) for operation with signals whose wavelengths are centered about a guide wavelength $\lambda_g$.

After providing $\mathbf{2}_n$ input ports and $\mathbf{2}_n$ output ports in process step 242, each input port is coupled to a respective output port with a through transmission line in step 244. At this point, the network has transmission between each input port and a respective output port and has perfect isolation but does not have power division because there are no transmission paths from any selected input port to all of the output ports. When n is even, the impedance of the through transmission lines is preferably set to $Z_c$ so that the network also has zero return loss. In the 8×8 power divider/combiner 160 of FIG. 8, the through transmission lines are the lines 162.

To provide additional transmission paths, shunt transmission lines are initially provided in step 246. These shunt lines provide pathways between an input port region and an output port region. Subsequently, in step 248, an input network of transmission lines is configured to couple the input ports to first ends of the shunt transmission lines and an output network of transmission lines is configured to couple second ends of the shunt transmission lines to output ports. This step completes the pathways so as to provide transmission paths which supplement the through transmission lines and conduct power from each input port to all of the output ports. In the 8×8 power divider/combiner 160 of FIG. 8, the shunt transmission lines are the lines 166 and 167. The input and output networks are configured to be identical.

After step 248, there exist transmission paths from each input port to all of the output ports. These paths must be established while maintaining the perfect isolation and, if n is even,, the zero return loss of step 244. If n is odd, these paths must also realize zero return loss at the input ports. To realize these objectives, it is necessary that the completed power divider/combiner have a $2^{n+1}$-fold symmetry at its ports. If n=3, for example, the network must appear the same from each of the $2^{n+1}$=16 ports.

Equivalently, the network must have interport and intraport symmetry as checked in process step 249. Interport symmetry is symmetry about a plane between the input and the output ports, e.g., the interport plane 250 in FIG. 8. Intraport symmetry is symmetry about a plane between equal sets of input ports and equal sets of output ports, e.g., the intraport plane 252 in FIG. 8. If the power divider/combiner has interport and intraport symmetry, it also has the requisite $2^{n+1}$-fold symmetry which means that each port (input and output) "sees" the same network. For example, the 8×8 power divider/combiner 160 of FIG. 8 appears the same to each of its input and output ports.

Process step 254 checks for equal division, at each output port, of the power from each input port. Then, if necessary, the power divider/combiner is rearranged in process step 256 to realize interport and intraport symmetry and equal power division. Steps 248, 249, 254 and 256 may need to be repeated as indicated by the loop 258 until symmetry is obtained along with zero return loss, perfect isolation and perfect power division.

Figure 12:
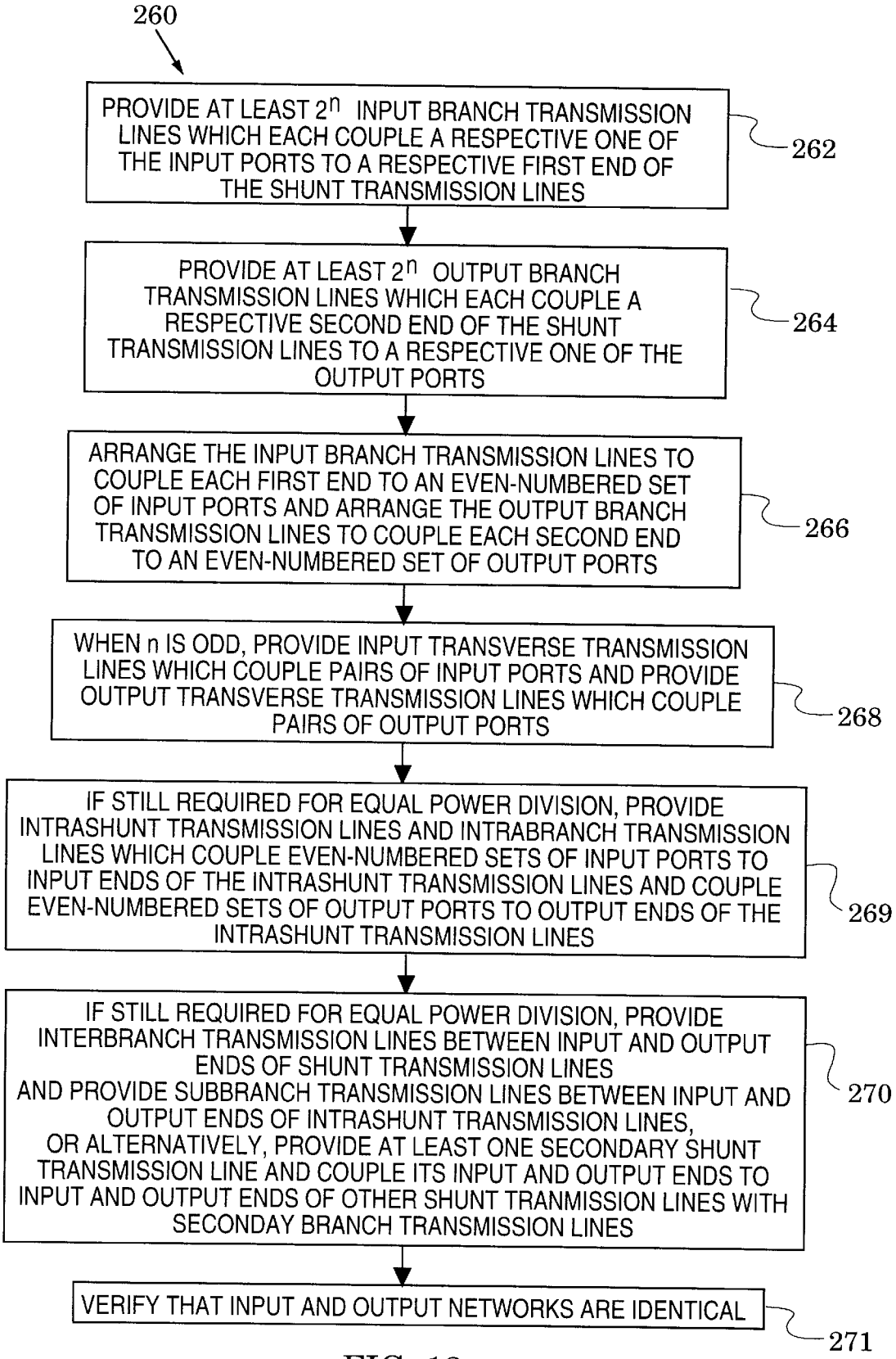
FIG. 12 is a flow diagram which illustrates details of the design processes of FIG. 11.

Process step 248 is further detailed in the flow chart 260 of FIG. 12. As shown in process step 262, the input network is provided with at least $2^n$ input branch transmission lines that each couple a respective one of the input ports to a respective first end of the shunt transmission lines. In the 8×8 power divider/combiner 160 of FIG. 8, the input branch transmission lines are the lines 168.

As shown in process step 264, the output network is also provided with at least $2^n$ output branch transmission lines that each couple a respective second end of the shunt transmission lines to a respective one of the output ports. In the 8×8 power divider/combiner 160 of FIG. 8, the output branch transmission lines are the lines 170.

The input branch transmission lines are arranged in step 266 to couple each first end to an even-numbered set of input ports. Similarly, the output branch transmission lines are arranged to couple each second end to an even-numbered set of output ports. In the 8×8 power divider/combiner 160 of FIG. 8, for example, first ends of the shunt transmission lines 166 and 167 are each coupled to sets of four input ports.

As stated above, the completed power divider/combiner must realize equal power division and perfect return loss while not degrading the isolation of the through transmission lines. This may require the input and output networks to include transverse transmission lines as stated in process step 268. This step is especially useful when n is odd and will typically require $2^n/2$ transverse transmission lines at the input ports and a like number at the output ports. For example, in the 8×8 power divider/combiner 80 of FIG. 5 (where n=3), the transverse transmission lines are the lines 164 and 165 which respectively couple pairs of input ports and pairs of output ports.

As illustrated in process step 269, obtaining equal power division may also require intrashunt transmission lines (e.g., the intrashunt transmission lines 200 in FIG. 9) and intrabranch transmission lines (e.g., the intrabranch transmission lines 187 in FIG. 9) which couple even-numbered sets of input ports to input ends of the intrashunt transmission lines and which couple even-numbered sets of output ports to output ends of the intrashunt transmission lines.

Process step 270 states that interbranch transmission lines (e.g., the interbranch transmission lines 208 in FIG. 9) may be required to obtain equal power division. These interbranch transmission lines connect input and output ends of shunt transmission lines (e.g., the shunt transmission lines 166 and 167 in FIG. 9) of different portions of a power divider/combiner. Subbranch transmission lines (e.g., the subbranch transmission lines 202 in FIG. 9) may also be required between input and output ends of intrashunt transmission lines.

Process step 270 further states that, alternatively, equal power division may be obtained by adding at least one secondary shunt transmission line (e.g., the secondary shunt transmission lines 222 in FIG. 10) and coupling its input and output ends to input and output ends of other shunt transmission lines (e.g., the intrashunt transmission lines 200 in FIG. 10 or the shunt transmission lines 166 and 167 in FIG. 10) with secondary branch transmission lines (e.g., the secondary branch transmission lines 224 and 226 in FIG. 10).

Finally, in step 271, it is again verified that the input and output networks are identical.

In general, all of the transmission lines have an electrical length of $\lambda_g/4$. However, variations of the $2^n \times 2^n$ power divider/combiners can be tailored to enhance particular parameters (e.g., insertion loss, weight and volume) by reducing the length of selected lines. This enhancement can also be supplemented by modifying the impedance of selected lines as exemplified above in specific power divider/combiner descriptions.

At each step of the power divider/combiner design, performance parameters of return loss, isolation and power division may be monitored with various analyses methods. For example, the input and output ports can be excited with combinations of even signals (i.e., signals which are in-phase) and odd signals (i.e., signals which are 180° out-of-phase). More specifically, port 1 is excited at 0° and other ports are excited at 0° in some modes and 180° in other modes.

In this even/odd analysis, interport and intraport symmetry of the power divider/combiners of the invention allows a designer to place short and open circuits at various network points so that the whole network can be separated into $2^{n+1}$ identical 1-port networks. Thus, the network response to each excitation mode can be found by determining the reflection coefficient for a 1-port network. Superposition of the mode responses yields the network response when only one port is excited.

The embodiments of FIGS. 5, 8, 9 and 10 have been described with reference to input and output ports. Because of the interport and intraport symmetry of these networks, however, the terms input and output are intended to facilitate description only. Either set of ports can be selected for input excitation with output signals taken from the other port set.

The term through transmission line has been applied to a line (e.g., any of the through lines 162 in FIG. 8) that couples an input port to a respective output port. A shunt transmission line (e.g., one of the shunt lines 166 and 167 in FIG. 8 or the intrashunt lines 200 in FIG. 9) is one that provides an alternate transmission path from the input network to the output network.

Input branch transmission lines (e.g., one of the input branch lines 168 or the input intrabranch lines 187 in FIG. 9) couple input ports to first ends of shunt lines and output branch transmission lines (e.g., one of the output branch lines 170 or the output intrabranch lines 197 in FIG. 9) couple second ends of shunt lines to output ports to thereby provide transmission paths from each input port to all output ports for equal power division. Other branch transmission lines (e.g., the interbranch lines 208 and the subbranch transmission lines 202 and 204 in FIG. 9) couple ends of different shunt transmission lines.

Input transverse transmission lines (e.g., one of the input transverse lines 164 in FIG. 8) are ones which couple pairs of input ports and output transverse transmission lines (e.g., one of the output transverse lines 165 in FIG. 8) are ones which couple pairs of output ports. Transverse lines are especially useful in power divider/combiners in which n is odd.

Although the embodiments of FIGS. 5, 8, 9 and 10 have been shown with a particular spatial relationship, it should be understood that fabricated realizations may be variously arranged to facilitate production or to further reduce their volume. Physical symmetry is not required, but electromagnetic symmetry is (i.e., transmission line lengths and impedances should be symmetric).

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A power divider/combiner for dividing received powers at each of 4 input ports, transmitting the divided powers to each of 4 output ports and combining the transmitted powers at each of said output ports, the power divider/combiner comprising:

4 through transmission lines, each coupling a respective one of said input ports to a respective one of said output ports;

a shunt transmission line;

4 input branch transmission lines, each coupling a respective one of said input ports and a first end of said shunt transmission line; and 4 output branch transmission lines, each coupling a respective one of said output ports and a second end of said shunt transmission line.

2. The power divider/combiner of claim 1, wherein said transmission lines are waveguides.

3. The power divider/combiner of claim 1, wherein said transmission lines are coaxial lines.

4. The power divider/combiner of claim 1, wherein said transmission lines are planar transmission lines.

5. The power divider/combiner of claim 1, wherein all of said transmission lines have substantially the same length.

6. The power divider/combiner of claim 5, wherein said power divider/combiner is configured for operation with signals having a guide wavelength $\lambda_g$ and all of said transmission lines have an electrical length of substantially $\lambda_g/4$.

7. The power divider/combiner of claim 1, wherein said through transmission lines, said input branch transmission lines and said output branch transmission lines have a characteristic impedance $Z_c$ and said shunt transmission line has an impedance $Z_s$ wherein $Z_s=Z_c/2$.

8. The power divider/combiner of claim 1, wherein:

said through transmission line has a characteristic impedance $Z_c$; and said input and output branch transmission lines each have an impedance $Z_b$ and said shunt transmission line has an impedance $Z_s$ which are related by an equation of $Z_b^2/Z_s=2Z_c$.

9. The power divider/combiner of claim 1, wherein:

said through transmission line has a characteristic impedance $Z_c$ and an electrical length $\theta_t$; and said input and output branch transmission lines each have an impedance $Z_b$ and said shunt transmission line has an impedance $Z_s$ which are related by an equation of $Z_b^2/Z_s=2Z_c\sin\theta_t$.

10. The power divider/combiner of claim 1, wherein each of said through transmission lines is extended to include:

an input extended transmission line that facilitates coupling of signals to the input port associated with that through transmission line; and an output extended transmission line that facilitates coupling of signals to the output port associated with that through transmission line.

11. A power divider/combiner for dividing received power at each of 8 input ports, transmitting the divided powers to each of 8 output ports and combining the transmitted powers at each of said output ports, the power divider/combiner comprising:

8 through transmission lines of which 4 each couple a respective input port of a first set of said input ports to a respective output port of a first set of said output ports and another 4 each couple a respective input port of a second set of said input ports to a respective output port of a second set of said output ports;

4 input transverse transmission lines, each coupling a respective input port of said first input-port set and a respective input port of said second input-port set;

4 output transverse transmission lines, each coupling a respective output port of said first output-port set and a respective output port of said second output-port set;

first and second shunt transmission lines;

8 input branch transmission lines of which 4 each couple a first end of said first shunt transmission line to a respective input port of said first input-port set and another 4 each couple a first end of said second shunt transmission line to a respective input port of said second input-port set; and 8 output branch transmission lines of which 4 each couple a second end of said first shunt transmission line to a respective output port of said first output-port set and another 4 each couple a second end of said second shunt transmission line to a respective output port of said second output-port set.

12. The power divider/combiner of claim 11, wherein said transmission lines are waveguides.

13. The power divider/combiner of claim 11, wherein said transmission lines are coaxial lines.

14. The power divider/combiner of claim 11, wherein said transmission lines are planar transmission lines.

15. The power divider/combiner of claim 11, wherein said transmission lines have substantially the same length.

16. The power divider/combiner of claim 15, wherein said power divider/combiner is configured for operation with signals having a guide wavelength $\lambda_g$ and all of said transmission lines have an electrical length of substantially $\lambda_g/4$.

17. The power divider/combiner of claim 11, wherein:

said transverse transmission line has a characteristic impedance $Z_c$;

said through transmission lines each have an impedance $Z_t=Z_c/(2)^{1/2}$; and said input and output branch transmission lines each have an impedance $Z_b$ and said shunt transmission line has an impedance $Z_s$ wherein $Z_b^2/Z_s=Z_c(2)^{1/2}$.

18. The power divider/combiner of claim 11, wherein each of said through transmission lines is extended to include:

an input extended transmission line that facilitates coupling of signals to the input port associated with that through transmission line; and an output extended transmission line that facilitates coupling of signals to the output port associated with that through transmission line.

19. A power divider/combiner for dividing received power at each of 16 input ports, transmitting the divided powers to each of 16 output ports and combining the transmitted powers at each of said output ports, the power divider/combiner comprising:

a first transmission-line network which includes:

a) 8 through transmission lines of which 4 each couple a respective input port of a first set of said input ports to a respective output port of a first set of said output ports and another 4 each couple a respective input port of a second set of said input ports to a respective output port of a second set of said output ports;

b) 4 input intrabranch transmission-line pairs, each coupling a respective input port of said first input-port set and a respective input port of said second input-port set wherein each of said input intrabranch transmission-line pairs includes 2 input intrabranch transmission lines which are serially joined at an input-pair node;

c) 4 output intrabranch transmission-line pairs, each coupling a respective output port of said first output-port set and a respective output port of said second output-port set wherein each of said output intrabranch transmission-line pairs includes 2 output intrabranch transmission lines which are serially joined at an output-pair node;

d) first and second shunt transmission lines;

e) 8 input branch transmission lines of which 4 each couple a first end of said first shunt transmission line to a respective input port of said first input-port set and another 4 each couple a first end of said second shunt transmission line to a respective input port of said second input-port set; and f) 8 output branch transmission lines of which 4 each couple a second end of said first shunt transmission line to a respective output port of said first output-port set and another 4 each couple a second end of said second shunt transmission line to a respective output port of said second output-port set; and a second transmission-line network which includes:

a) 8 through transmission lines of which 4 each couple a respective input port of a third set of said input ports to a respective output port of a third set of said output ports and another 4 each couple a respective input port of a fourth set of said input ports to a respective output port of a fourth set of said output ports;

b) 4 input intrabranch transmission-line pairs, each coupling a respective input port of said third input-port set and a respective input port of said fourth input-port set wherein each of said input intrabranch transmission-line pairs includes 2 input intrabranch transmission lines which are serially joined at an input-pair node;

c) 4 output intrabranch transmission-line pairs, each coupling a respective output port of said third output-port set and a respective output port of said fourth output-port set wherein each of said output intrabranch transmission-line pairs includes 2 output intrabranch transmission lines which are serially joined at an output-pair node;

d) first and second shunt transmission lines;

e) 8 input branch transmission lines of which 4 each couple a first end of said first shunt transmission line to a respective input port of said third input-port set and another 4 each couple a first end of said second shunt transmission line pairs to a respective input port of said fourth input-port set; and f) 8 output branch transmission lines of which 4 each couple a second end of said first shunt transmission line to a respective output port of said third output-port set and another 4 each couple a second end of said second shunt transmission line to a respective output port of said fourth output-port set;

wherein each of the input-pair nodes of said first transmission line network is coupled to a respective one of the input-pair nodes of said second transmission line network to form a set of 4 common input-pair nodes;

and wherein each of the output-pair nodes of said first transmission line network is coupled to a respective one of the output-pair nodes of said second transmission line network to form a set of 4 common output-pair nodes;

and further including:

four intrashunt transmission lines, each coupled between a respective one of said input-pair nodes and a respective one of said output-pair nodes;

four input subbranch transmission lines having first ends that are joined together and having second ends which are each coupled to a respective one of said input-pair nodes;

four output subbranch transmission lines having first ends that are joined together and having second ends which are each coupled to a respective one of said output-pair nodes four input interbranch transmission lines extending away from a common node and each coupled to an input end of a respective one of said shunt transmission lines; and four output interbranch transmission lines extending away from a common node and each coupled to an output end of a respective one of said shunt transmission lines.

20. The power divider/combiner of claim 19, wherein said transmission lines are waveguides.

21. The power divider/combiner of claim 19, wherein said transmission lines are coaxial lines.

22. The power divider/combiner of claim 19, wherein said transmission lines are planar transmission lines.

23. The power divider/combiner of claim 19, wherein said transmission lines have substantially the same length.

24. The power divider/combiner of claim 23, wherein said power divider/combiner is configured for operation with signals having a guide wavelength $\lambda_g$ and all of said transmission lines have an electrical length of substantially $\lambda_g/4$.

25. The power divider/combiner of claim 19, wherein:

said through transmission lines have a characteristic impedance $Z_c$; and an electrical length $\theta_t$;

said input branch transmission lines, said output branch transmissions lines, said input intrabranch transmission lines and said output intrabranch transmission lines have an impedance $Z_b$; and said shunt transmission lines and said intrashunt transmission lines have an impedance $Z_s$ in which $Z_b^2/Z_s = 2Z_c\sin\theta_t$.

26. The power divider/combiner of claim 19, wherein each of said through transmission lines is extended to include:

an input extended transmission line that facilitates coupling of signals to the input port associated with that through transmission line; and an output extended transmission line that facilitates coupling of signals to the output port associated with that through transmission line.

27. A power divider/combiner for dividing received power at each of 16 input ports, transmitting the divided powers to each of 16 output ports and combining the transmitted powers at each of said output ports, the power divider/combiner comprising:

a first transmission-line network which includes:

a) 8 through transmission lines of which 4 each couple a respective input port of a first set of said input ports to a respective output port of a first set of said output ports and another 4 each couple a respective input port of a second set of said input ports to a respective output port of a second set of said output ports;

b) 4 input intrabranch transmission-line pairs, each coupling a respective input port of said first input-port set and a respective input port of said second input-port set wherein each of said input intrabranch transmission-line pairs includes 2 input intrabranch transmission lines which are serially joined at an input-pair node;

c) 4 output intrabranch transmission-line pairs, each coupling a respective output port of said first output-port set and a respective output port of said second output-port set wherein each of said output intrabranch transmission-line pairs include 2 output intrabranch transmission lines which are serially joined at an output-pair node;

d) first and second shunt transmission lines;

e) 8 input branch transmission lines of which 4 each couple a first end of said first shunt transmission line to a respective input port of said first input-port set and another 4 each couple a first end of said second shunt transmission line to a respective input port of said second input-port set; and f) 8 output branch transmission lines of which 4 each couple a second end of said first shunt transmission line to a respective output port of said first output-port set and another 4 each couple a second end of said second shunt transmission line to a respective output port of said second output-port set; and a second transmission-line network which includes:

a) 8 through transmission lines of which 4 each couple a respective input port of a third set of said input ports to a respective output port of a third set of said output ports and another 4 each couple a respective input port of a fourth set of said input ports to a respective output port of a fourth set of said output ports;

b) 4 input intrabranch transmission-line pairs, each coupling a respective input port of said third input-port set and a respective input port of said fourth input-port set wherein each of said input intrabranch transmission-line pairs includes 2 input intrabranch transmission lines which are serially joined at an input-pair node;

c) 4 output intrabranch transmission-line pairs, each coupling a respective output port of said third output-port set and a respective output port of said fourth output-port set wherein each of said output intrabranch transmission-line pairs includes 2 output intrabranch transmission lines which are serially joined at an output-pair node;

d) first and second shunt transmission lines;

e) 8 input branch transmission lines of which 4 each couple a first end of said first shunt transmission line to a respective input port of said third input-port set and another 4 each couple a first end of said second shunt transmission line pairs to a respective input port of said fourth input-port set;

and f) 8 output branch transmission lines of which 4 each couple a second end of said first shunt transmission line to a respective output port of said third output-port set and another 4 each couple a second end of said second shunt transmission line to a respective output port of said fourth output-port set;

wherein each of the input-pair nodes of said first transmission line network is coupled to a respective one of the input-pair nodes of said second transmission line network to form a set of 4 common input-pair nodes;

and wherein each of the output-pair nodes of said first transmission line network is coupled to a respective one of the output-pair nodes of said second transmission line network to form a set of 4 common output-pair nodes;

and further including:

four intrashunt transmission lines, each coupled between a respective one of said input-pair nodes and a respective one of said output-pair nodes;

a secondary shunt transmission line;

4 input secondary branch transmission lines which each couple a first end of said secondary shunt transmission line to a respective one of said input-pair nodes; and 4 output secondary branch transmission lines which each couple a second end of said secondary shunt transmission line to a respective one of said output-pair nodes.

28. A power divider/combiner for dividing received power at each of 16 input ports, transmitting the divided powers to each of 16 output ports and combining the transmitted powers at each of said output ports, the power divider/combiner comprising:

a first transmission-line network which includes:

a) 8 through transmission lines of which 4 each couple a respective input port of a first set of said input ports to a respective output port of a first set of said output ports and another 4 each couple a respective input port of a second set of said input ports to a respective output port of a second set of said output ports;

b) 4 input intrabranch transmission-line pairs, each coupling a respective input port of said first input-port set and a respective input port of said second input-port set wherein each of said input intrabranch transmission-line pairs includes 2 input intrabranch transmission lines which are serially joined at an input-pair node;

c) 4 output intrabranch transmission-line pairs, each coupling a respective output port of said first output-port set and a respective output port of said second output-port set wherein each of said output intrabranch transmission-line pairs includes 2 output intrabranch transmission lines which are serially joined at an output-pair node;

d) first and second shunt transmission lines;

e) 8 input branch transmission lines of which 4 each couple a first end of said first shunt transmission line to a respective input port of said first input-port set and another 4 each couple a first end of said second shunt transmission line to a respective input port of said second input-port set; and f) 8 output branch transmission lines of which 4 each couple a second end of said first shunt transmission line to a respective output port of said first output-port set and another 4 each couple a second end of said second shunt transmission line to a respective output port of said second output-port set; and a second transmission-line network which includes:

a) 8 through transmission lines of which 4 each couple a respective input port of a third set of said input ports to a respective output port of a third set of said output ports and another 4 each couple a respective input port of a fourth set of said input ports to a respective output port of a fourth set of said output ports;

b) 4 input intrabranch transmission-line pairs, each coupling a respective input port of said third input-port set and a respective input port of said fourth input-port set wherein each of said input intrabranch transmission-line pairs includes 2 input intrabranch transmission lines which are serially joined at an input-pair node;

c) 4 output intrabranch transmission-line pairs, each coupling a respective output port of said third output-port set and a respective output port of said fourth output-port set wherein each of said output intrabranch transmission-line pairs includes 2 output intrabranch transmission lines which are serially joined at an output-pair node;

d) first and second shunt transmission lines;

e) 8 input branch transmission lines of which 4 each couple a first end of said first shunt transmission line to a respective input port of said third input-port set and another 4 each couple a first end of said second shunt transmission line pairs to a respective input port of said fourth input-port set; and f) 8 output branch transmission lines of which 4 each couple a second end of said first shunt transmission line to a respective output port of said third output-port set and another 4 each couple a second end of said second shunt transmission line to a respective output port of said fourth output-port set;

wherein each of the input-pair nodes of said first transmission line network is coupled to a respective one of the input-pair nodes of said second transmission line network to form a set of 4 common input-pair nodes;

and wherein each of the output-pair nodes of said first transmission line network is coupled to a respective one of the output-pair nodes of said second transmission line network to form a set of 4 common output-pair nodes;

and further including:

four intrashunt transmission lines, each coupled between a respective one of said input-pair nodes and a respective one of said output-pair nodes;

a secondary shunt transmission line;

4 input secondary branch transmission lines, which each couple a first end of said secondary shunt transmission line to, respectively, first ends of the first and second shunt transmission lines of said first network and first ends of the first and second shunt transmission lines of said second network; and 4 output secondary branch transmission lines, which each couple a second end of said secondary shunt transmission line to, respectively, second ends of the first and second shunt transmission lines of said first network and second ends of the first and second shunt transmission lines of said second network.

29. A power divider/combiner for dividing received powers at each of $2^n$ input ports, transmitting the divided powers to each of $2^n$ output ports and combining the transmitted powers at each of said output ports, wherein n is an integer>1, the power divider/combiner comprising:

$2^n$ through transmission lines which each couple a respective one of said input ports to a respective one of said output ports;

m shunt transmission lines wherein m is an integer$\geqq$1;

an input network of transmission lines which couples said input ports to first ends of said shunt transmission lines; and an output network of transmission lines which couples second ends of said shunt transmission lines to said output ports to thereby provide transmission paths from each of said input ports to each of said output ports, said input and output transmission-line networks configured to be identical and to cause said power divider/combiner to have interport symmetry between said input and output ports and intraport symmetry between any equal sets of input and output ports.

30. The power divider/combiner of claim 29, wherein:

said input network includes at least $2^n$ input branch transmission lines which each couple a respective one of said input ports to a respective one of said first ends of said shunt transmission lines; and said output network includes at least $2^n$ output branch transmission lines which each couple a respective one of said second ends of said shunt transmission lines to a respective one of said output ports.

31. The power divider/combiner of claim 29, wherein:

said input network includes a plurality of input branch transmission lines which couple each first end of said shunt transmission lines to an even-numbered set of said input ports; and said output network includes a plurality of output branch transmission lines which couple each second end of said shunt transmission lines to an even-numbered set of said output ports.

32. The power divider/combiner of claim 29, further including:

$2^n/2$ input transverse transmission lines which each couple a respective pair of said input ports; and $2^n/2$ output transverse transmission lines which each couple a respective pair of said output ports.

33. The power divider/combiner of claim 29, wherein said transmission lines are waveguides.

34. The power divider/combiner of claim 29, wherein said transmission lines are coaxial lines.

35. The power divider/combiner of claim 29, wherein said transmission lines are planar transmission lines.

36. The power divider/combiner of claim 29, wherein said transmission lines have substantially the same length.

37. The power divider/combiner of claim 36, wherein said power divider/combiner is configured for operation with signals having a guide wavelength $\lambda_g$ and all of said transmission lines have an electrical length of substantially $\lambda_g/4$.

* * * * *